US009035845B2

(12) United States Patent
Griffitts

(10) Patent No.: US 9,035,845 B2
(45) Date of Patent: May 19, 2015

(54) NICHROME RESISTIVE ACTIVE ELEMENT BROAD BAND ANTENNA

(71) Applicant: Carl Griffitts, California, MD (US)

(72) Inventor: Carl Griffitts, California, MD (US)

( * ) Notice: Subject to any disclaimer, the term of this patent is extended or adjusted under 35 U.S.C. 154(b) by 323 days.

(21) Appl. No.: 13/835,193

(22) Filed: Mar. 15, 2013

(65) Prior Publication Data

US 2013/0300623 A1 Nov. 14, 2013

Related U.S. Application Data

(60) Provisional application No. 61/644,749, filed on May 9, 2012.

(51) Int. Cl.

| | |
|---|---|
| ***H01Q 9/16*** | (2006.01) |
| ***H01Q 1/52*** | (2006.01) |
| ***H01Q 1/10*** | (2006.01) |
| ***H01Q 9/34*** | (2006.01) |

(52) U.S. Cl.
CPC . *H01Q 1/52* (2013.01); *H01Q 9/16* (2013.01); *H01Q 1/10* (2013.01); *H01Q 9/34* (2013.01); *H01Q 5/321* (2015.01)

(58) Field of Classification Search
CPC ..... H01Q 9/16; H01Q 1/52
USPC ..... 343/792, 790
See application file for complete search history.

(56) References Cited

U.S. PATENT DOCUMENTS

| | | | | |
|---|---|---|---|---|
| 2,387,829 | A * | 10/1945 | Burnham et al. | 338/214 |
| 5,260,540 | A * | 11/1993 | Kamimura et al. | 219/76.14 |
| 5,606,331 | A | 2/1997 | McCorkle | |
| 6,054,958 | A | 4/2000 | Holshouser et al. | |
| 6,218,993 | B1 | 4/2001 | Chao et al. | |
| 7,151,497 | B2 | 12/2006 | Crystal | |
| 7,531,803 | B2 | 5/2009 | Mittleman et al. | |
| 2003/0086701 | A1 * | 5/2003 | Motz | 392/479 |

* cited by examiner

*Primary Examiner* — Hoang V Nguyen
(74) *Attorney, Agent, or Firm* — Adam J. Cermak; Cermak Nakajima & McGowan LLP

(57) ABSTRACT

A nichrome resistive element is used in a closed electrical circuit to form an antenna.

8 Claims, 16 Drawing Sheets

1 to 262 MHZ SWR Readings

NICHROME RESISTIVE ACTIVE ELEMENT BROAD BAND ANTENNA

This application claims priority under 35 U.S.C. §119 to U.S. Provisional App. No. 61/644,749, by the inventor hereof, filed 9 May 2012, the entirety of which is incorporated by reference herein.

BACKGROUND

1. Field of Endeavor

The present invention relates to devices, systems, and processes useful for receiving and radiating radio frequencies from below 1 Megahertz (MHz) continuously through 200 MHz using a single antenna without the need for adjusting or tuning its physical or electrical length when changing the frequency of the transceiver for the desired band of interest.

2. Brief Description of the Related Art

Communication antennas are designed to be used on a particular frequency band or bands of interest. An antenna is designed to be a physical or electrical size, proven to be a ¼ to ½ wavelength or a multiple of such wavelength, in order to resonate on that band of interest in order to provide a good voltage standing wave ratio (VSWR) match to the transceiver for efficient operation. The impedance of current radio transmitters are made to match an industrial standard of 50 ohms. The formula for determining the physical size of a ½ wave dipole is calculated by 468/f, where f is in Megahertz (MHz) and the result is length in feet. For an example, the size of a ½ wave dipole tuned for the 80 meter band which is approximately 3.5 MHz would be calculated as 468/3.5=133 feet. This is a very large antenna. The lower the band of interest the larger the antenna becomes. The higher the frequency the smaller the antenna length becomes. For an example, the size of a ½ wave dipole tuned for the 2 meter band which is approximately 142 MHz would be calculated as 468/144=3.25 feet.

Current antenna designs made to operate on more than one band of frequencies are called multiband antennas. The common ones that are available are limited to 2 to 6 bands and are very narrow in bandwidth. Some designs use complicated Trap coils for each band which trap or impede certain sections of antennas elements to allow for multiband operations. These traps are fragile and have losses and are prone to overpower burnout and damage over time from weather. These are very complicated to assemble and tune as any adjustment made on one band will affect the other. These antennas require a ground radial system or counter poise if used in a vertical configuration.

Other antennas used for multiband operation use a balun transformer for impedance matching, which is prone to burn out and limits the amount of power that can be fed to the antenna from a transmitter. Log Periodic Yagi or beam antennas for multiband use are further limited due to size for the same reasons as just mentioned. Many other antennas that will not tune properly can be aided with an external antenna matching units which are expensive and time consuming to use every time the user needs to switch bands. There are automatic tuning units, or ATU, which require another power source to operate and get very expensive for higher power handling requirements.

All of these antennas mentioned above are subject to capacitive loading from nearby objects. They are affected by proximity to ground, trees, homes; even the feed line can greatly influence their resonance affecting the performance and VSWR readings matching the transceivers impedance.

Thus, there remains a need for antennae which suffer less from these deficiencies.

SUMMARY

According to a first aspect of the invention, an antenna comprises an elongate nichrome resistive element, and an electrically conductive sheath surrounding the elongate nichrome resistive element, wherein the elongate nichrome resistive element and the electrically conductive sheath are electrically in a closed circuit.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which:

FIG. 5A, 5B, illustrates the Nichrome resistive element antenna in a dipole driven element design used on a Beam or Yagi type antenna.

DETAILED DESCRIPTION OF EXEMPLARY EMBODIMENTS

Figure 1:
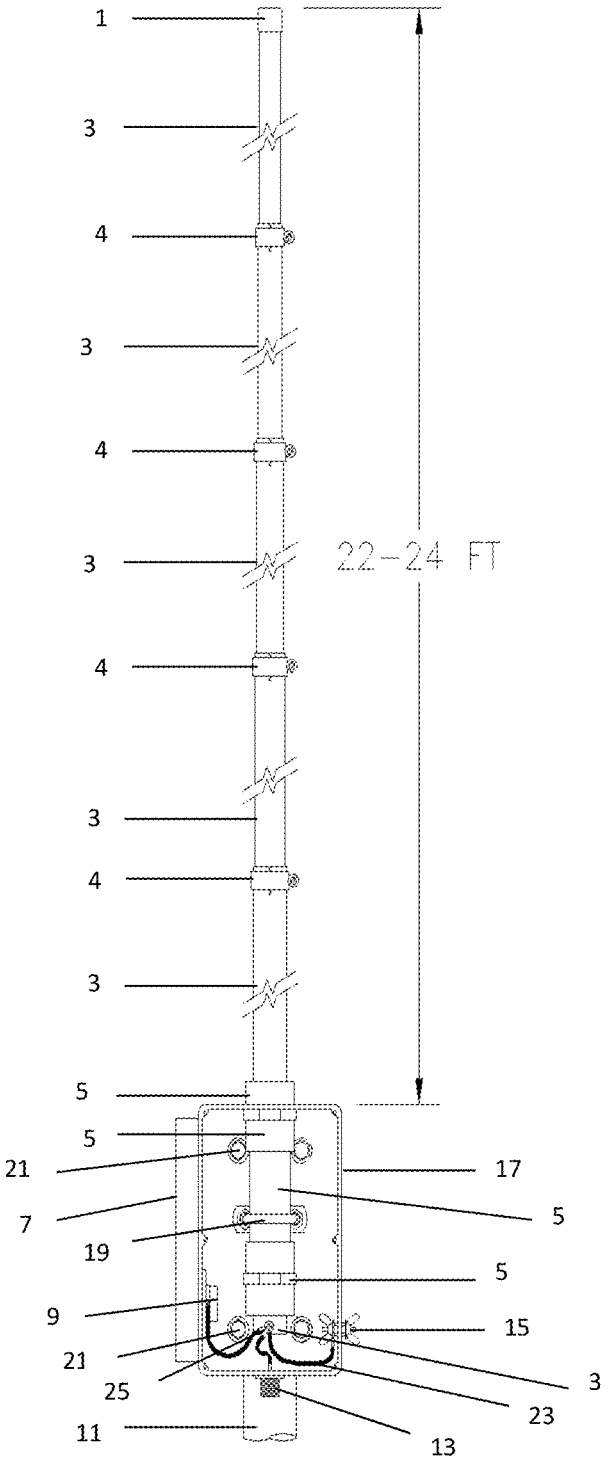
FIG. 1 illustrates a view of an exemplary Nichrome resistive element antenna in a vertical mono pole design.

Referring to the drawing figures, like reference numerals designate identical or corresponding elements throughout the several figures.

In general terms, antennae as described herein can remain tuned with a very acceptable low VSWR reading needed by the transmitter for proper efficient operation. Antennae as described herein can provide a continuous impedance match over the entire radio spectrum bands in the VLF, LF, MF, HF, and VHF frequencies without adjustments or external tuning devices. Antennae as described herein can be a one-size-fits-all antenna that is compact in size and very portable and practical in limited space where full size low band antennas are impractical and costly. Antennae as described herein can eliminate the need for a separate antenna for operating on many different bands, thus eliminating the need for large antennas and ground counter poise in restricted and limited space settings. Furthermore, only one antenna is needed to cover all bands of interest that is extremely broad banded with continuous coverage of those bands with no gaps, no external antenna tuning units, no baluns, and no ground counter poise. Antennae as described herein can bring a new meaning to the term "Broad Band Frequency Hopping" or "Spread Spectrum", in that it will immensely broaden the band that can be used for this type of transmission. They can have essentially unlimited range in frequency hopping as the impedance will not change as seen by the transmitter and eliminates multiple antennae and complex computer controlled antenna tuning units, simplifying setup of equipment and greatly reducing cost. Antennae as described herein can be used for fixed stations on land, portable and quick set up at remote locations, Mobil marine SSB HF radio service, Military service, Amateur radio, commercial, as well as other applications not described herein.

Throughout this disclosure, reference is made to a Nichrome material. Nichrome is a well-know class of materials, and is a non-magnetic alloy of nickel and chromium; some alloys include iron, particularly when the material is used as a resistance wire. A common alloy is 80% nickel and 20% chromium, by mass, but other ratios of Ni/Cr can be used, and other constituents can be included in the alloy, without departing from the scope of the present invention, as long as the material performs acceptably as described herein. Alternatively, however, other, less preferred materials can be used instead of Nichrome, although 80/20 Nichrome and Nichrome 60 (Ni 60%, Cr 16%, Fe 24%) are significantly preferred because of their superior performance in antennae. Nichrome has been found to significantly outperform other materials, in the uses described herein. Other resistance wire can be used with satisfactory results, so long as AWG and length are calculated out to match the 50 to 100 ohm value as shown with this antennae design described; however, because of the resistivity per unit length of the material greatly affects the size of the antenna, the use of other materials can result in antenna that are too large to be useful. Other possible wire materials include: (FeCrAl alloy) Ferritic iron-chromium-aluminium alloy, (NiCr alloy) Nickel-chromium alloy, (NiFe alloy) nickel-iron alloy, (CuNi alloy) copper-nickel alloy, (NiCrAlCu alloy) nickel-chromium-aluminium-copper alloy, (CuMnNi alloy) copper-manganese-nickel. This list is not exhaustive and as newer alloys are developed they may find uses in this design.

Referring to the drawings figures, FIG. 1 shows an exemplary antenna as a simple mono pole vertical antenna which is robust in design and can survive very high wind conditions due to its low cross sectional area. The antenna is preferably made of an aluminum telescoping radiating elements 3 held together with, e.g., compression clamps 4 that contain the Nichrome resistive element cable assembly 23 (FIG. 2) which fits through a PVC or other insulation fitting 5 installed in a (e.g., cast aluminum) enclosure 17. The insulator 5, along with the aluminum tube 3, is secured to the enclosure 17 with a u-bold 19 or other similar device. At the top end of the aluminum tube 3, there is a plastic or rubber dust/moister cap 1 covering the end of the tube 3 to prevent water and debris from entering. A heat sink 7 is mounted on the enclosure's outside surface 17 to dissipate heat from a high power, non-inductive power resistor 9 which is mounted inside of the enclosure 17 opposite of the heat sink 7. The enclosure assembly 17 is mounted by the end user's choice of a mast 11 held on by bolts 21 to external saddle clamps 29, as seen in FIG. 3C. A cover plate 31, is attached to the aluminum enclosure 17 with screws 27 as seen in FIGS. 3A and 3C Referring to FIG. 2, the drawing illustrates a closer view of the Nichrome resistive element cable assembly 23 inside the cut away view of the aluminum radiating elements 3, to show routing of cable 23 and connections at top screw 40 and return ground wing nut 15. Feed line from a transceiver is a RG-8 or equivalent type coaxial cable that connects to the coaxial receptacle 13 mounted on the enclosure 17. The center pin from connector 13 is wired to the resistor 9 and the aluminum radiating element 3 by connection point 25.

Figure 2:
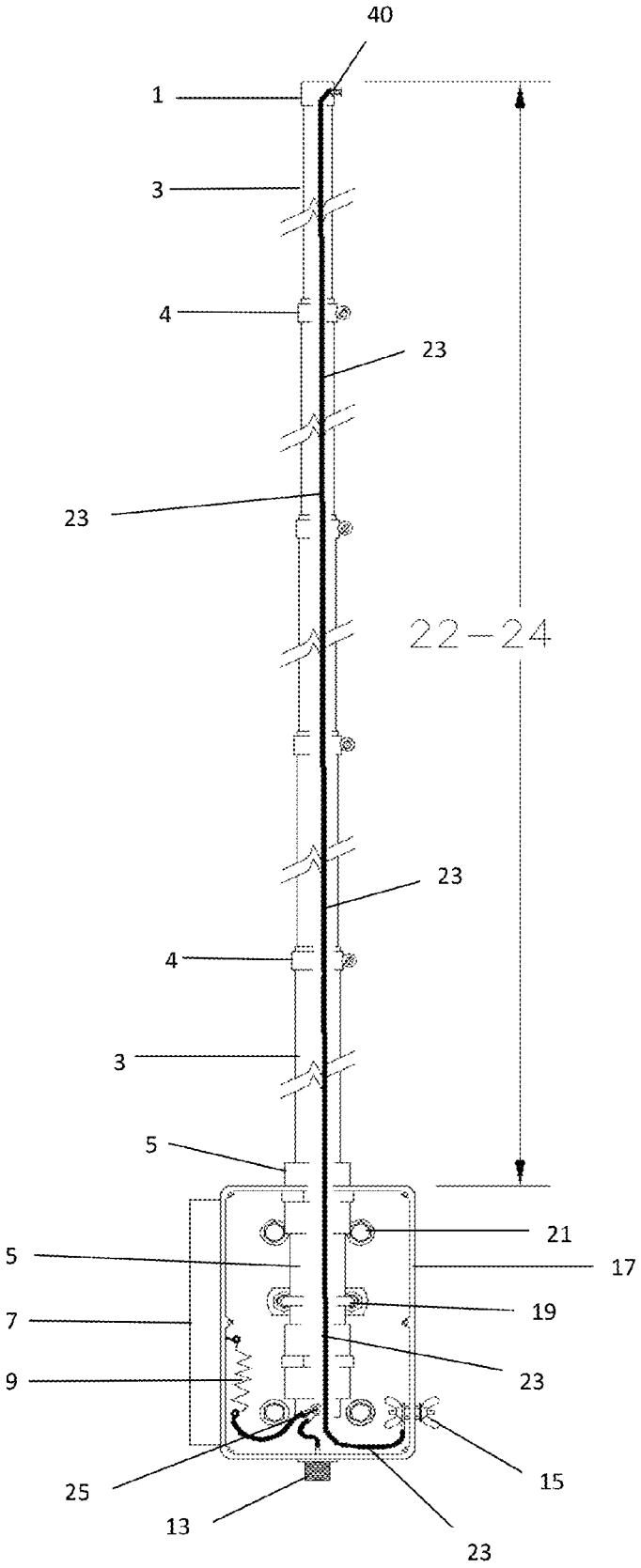
FIG. 2 illustrates a view with the main Nichrome element shown in a cut away for clarity.
Figure 3A:
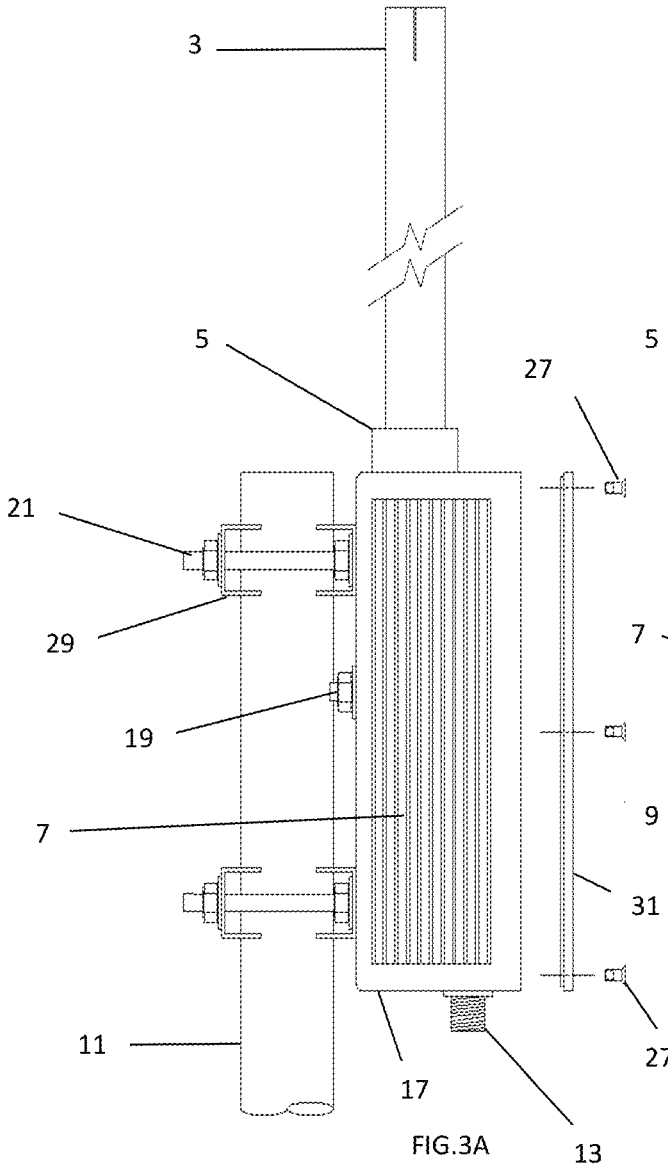
FIG. 3A, 3B, 3C illustrate enlarged views of the main enclosure containing various components.
Figure 3B:
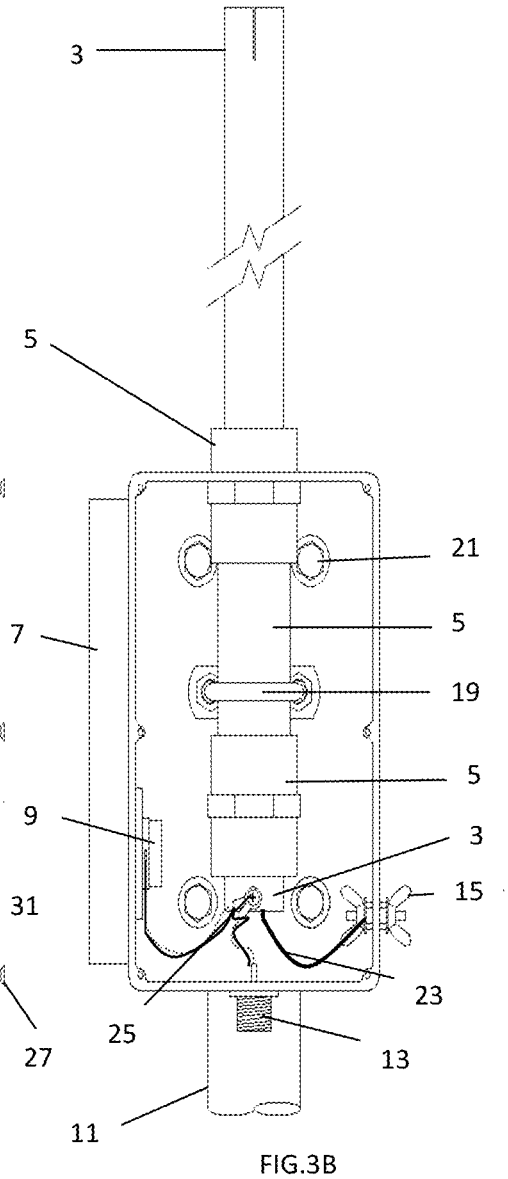
Figure 3C:
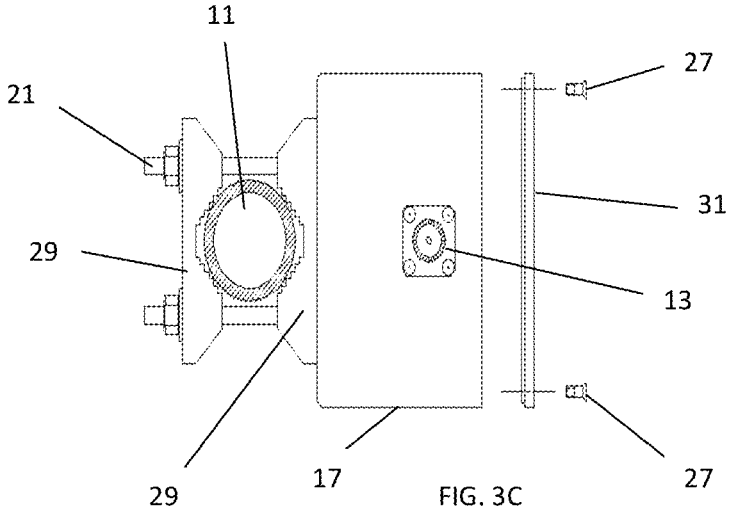
Figure 15:
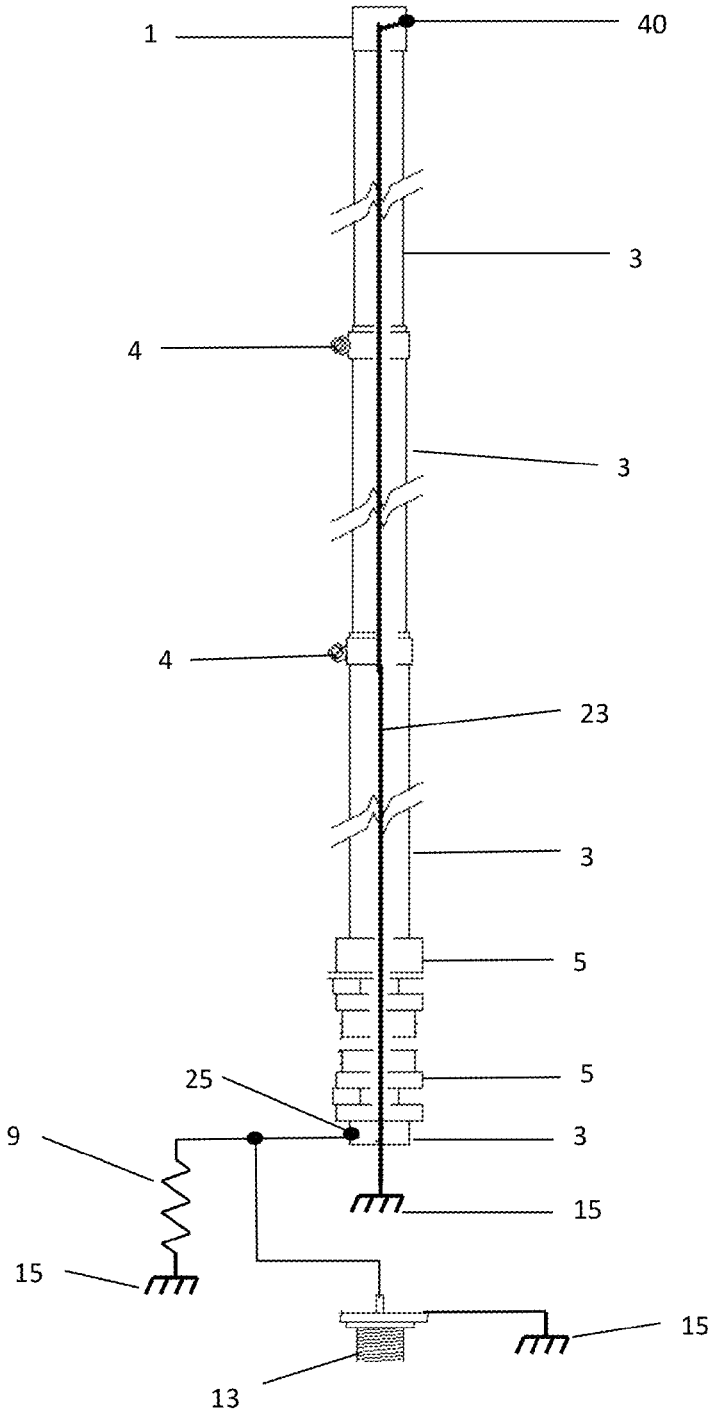
FIG. 15 illustrates a schematic diagram of an exemplary antenna as shown in FIG. 1 and FIG. 2.

Referring to FIG. 15, the drawing illustrates a schematic diagram of the complete electrical wiring of the embodiment illustrated in FIG. 1 and FIG. 2. As can be seen by tracing the input coaxial receptacle 13 wiring through the aluminum elements 3 to the top connection at 40, where one end of the Nichrome resistive wire cable assembly 23 is terminated and then follow the Nichrome cable assembly 23 back down to the grounding wing nut 15. Resistor 9 is in parallel or shunted across the Nichrome assembly 23 and the aluminum elements 3 for a closed loop circuit that, in this case, has a resistivity of 50 ohms. The high power non-inductive resistor 9, in this exemplary embodiment, is valued at 100 ohms and is capable of 800 watts power dissipation. The length of the Nichrome resistance wire assembly 23 is 28 AWG and is 4.25 ohms/ft. The length is 23.5 feet for approximately 100 ohms. With these 2 values of 100 ohms in parallel, using Ohm's law, the calculated resistance at the coaxial receptacle is 50 ohms, which will match the industry's standard of 50 ohms impedance of transceivers. Thus, this embodiment is a purely resistive load antenna which has very nominal capacitive reactance, which, while not being limited to a particular theory, is how the antenna can remain superbly matched to any transceiver at any frequencies from below 1 MHz to 200 MHz.

Figure 14:
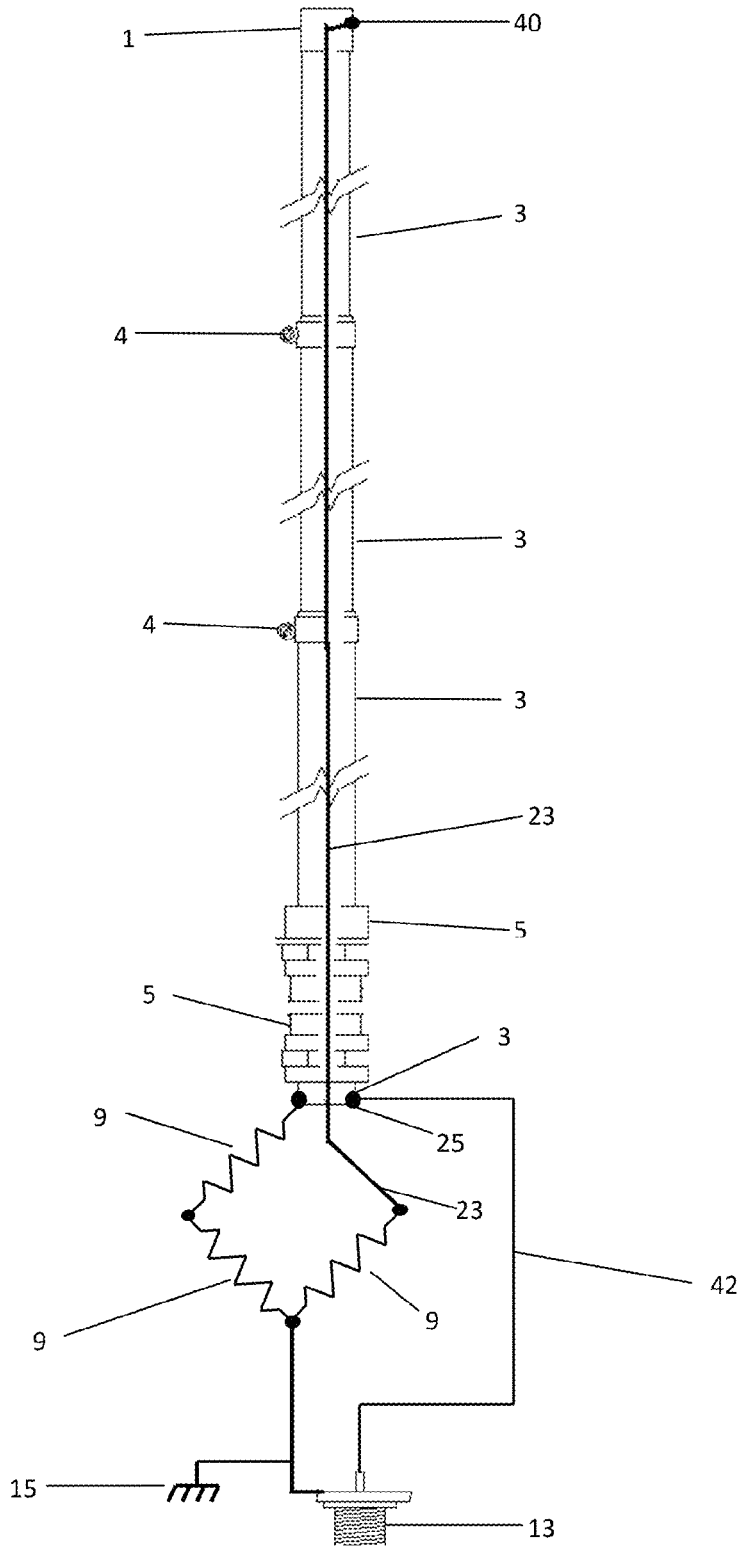
FIG. 14 illustrates a schematic diagram of an exemplary antenna in a full bridge configuration.

Referring to FIG. 14, the drawing illustrates a physically shorter version of the antenna described with reference to FIG. 15, by using a ¾ bridge arrangement using three non-inductive resistors 9 with a value of 50 ohms each, along with a shorter Nichrome cable assembly 23 that is 11.6 feet in length, to equal 50 ohms. This shorter version is well-suited for mobile operations on a vehicle or the like.

Figure 4:
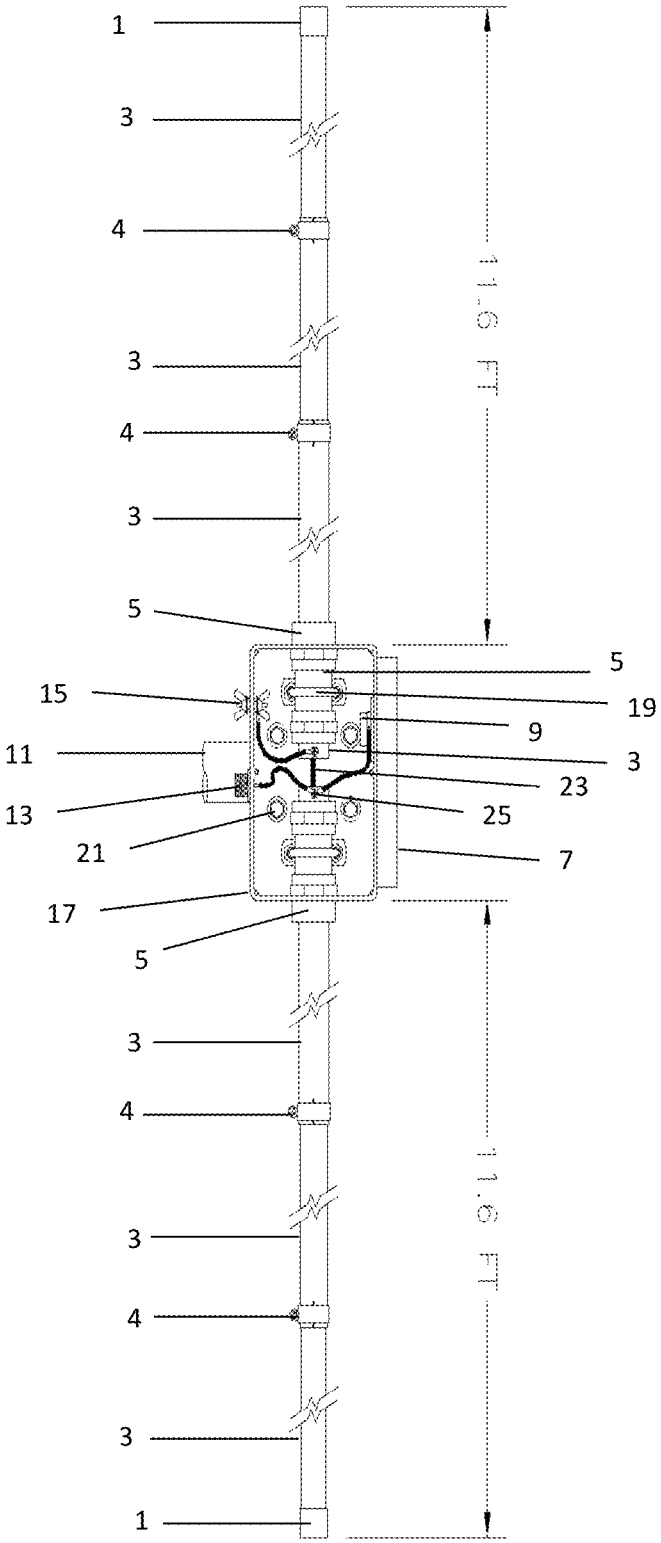
FIG. 4 illustrates a Nichrome resistive element antenna in a dipole configuration.
Figure 5A:
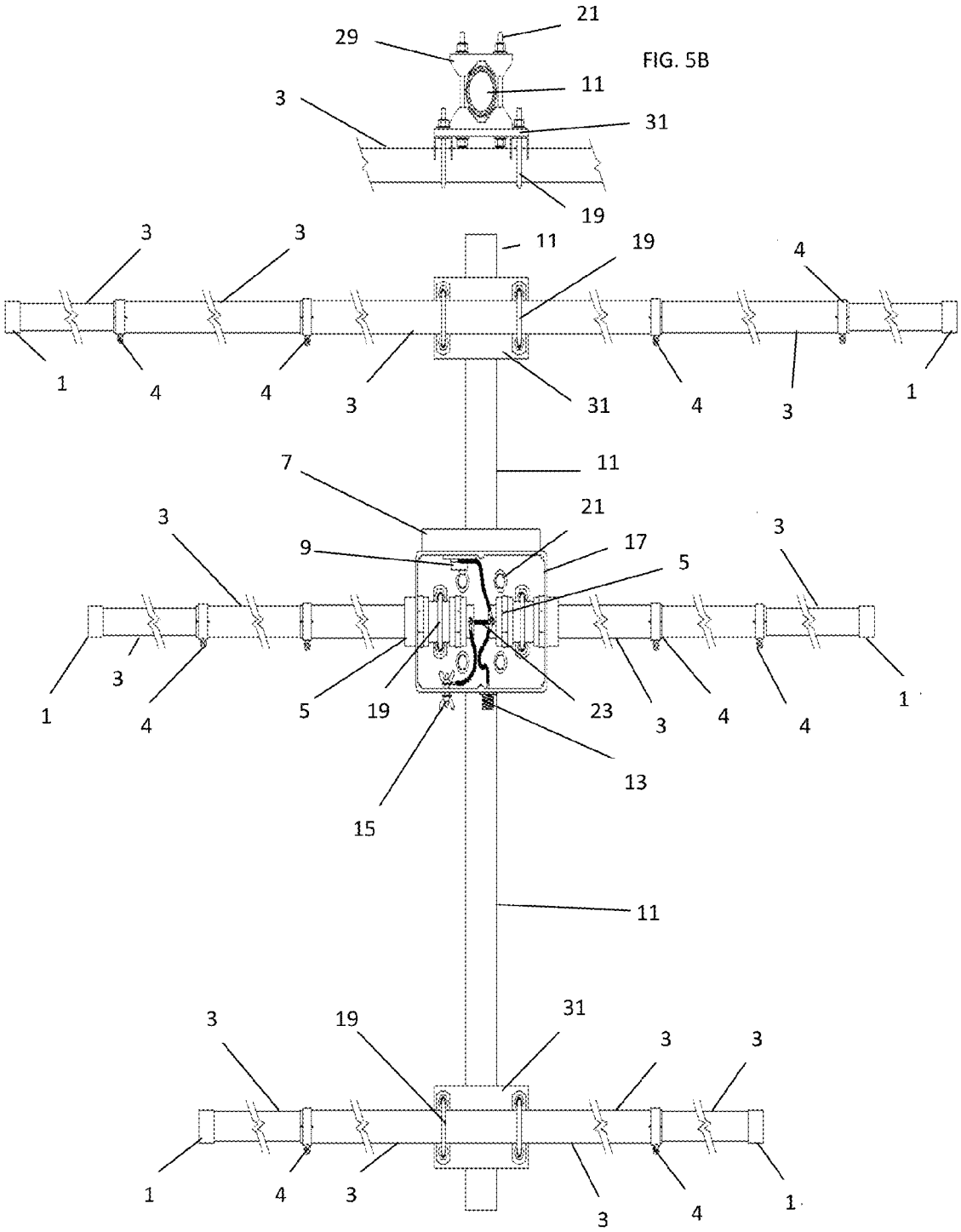
Figure 6:
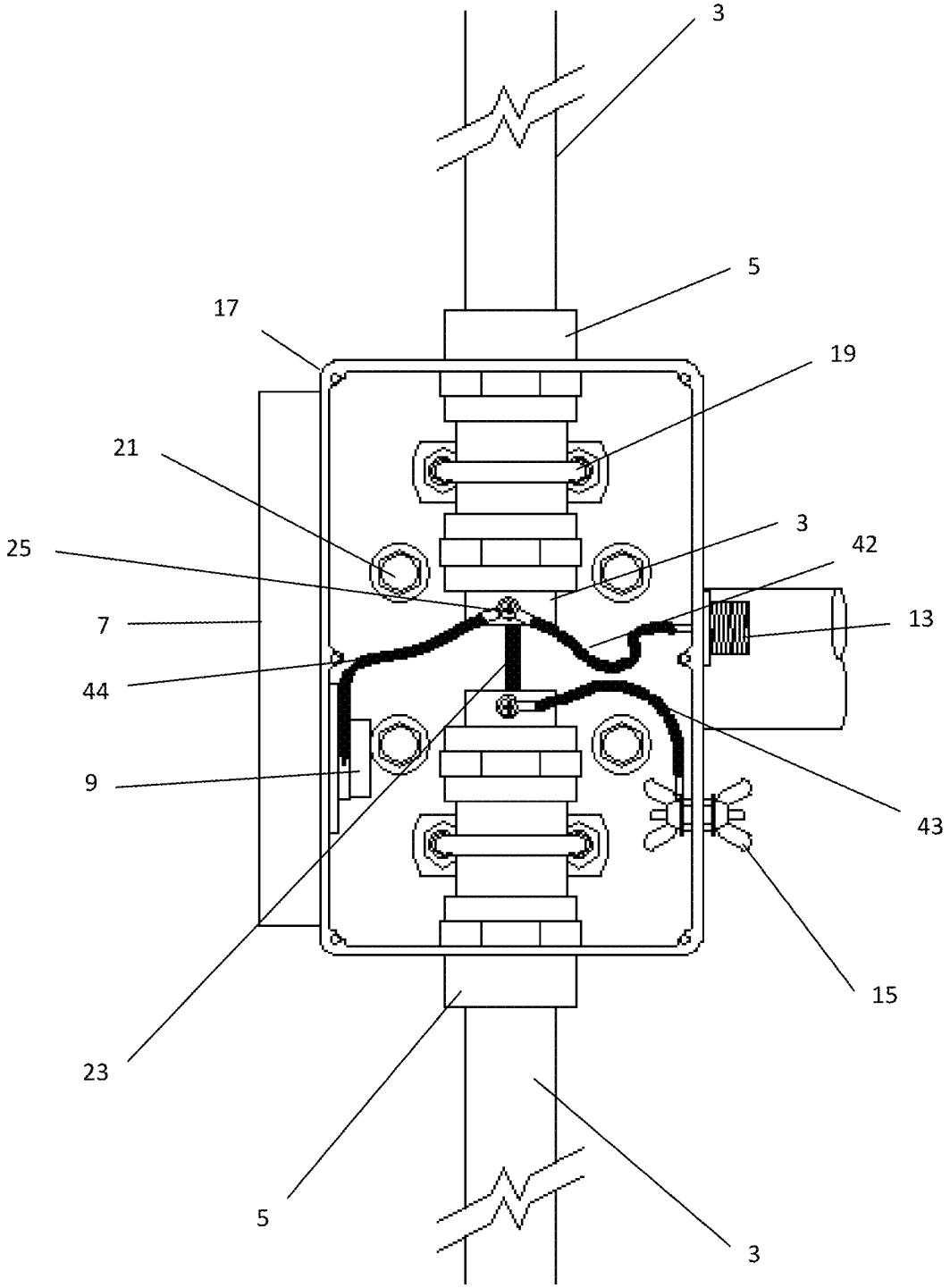
FIG. 6 illustrates an enlarged view of the dipole and driven element arrangement for clarity.

Referring to FIG. 4, the drawing illustrates an exemplary dipole configuration that can be used as a standalone rotatable dipole or as a driven element on a Log Periodic Yagi type or multi-element beam antenna, to greatly increase gain and directivity, as illustrated in FIG. 5A. A mounting plate 31 attaches the element 3 to boom 11 as shown in FIGS. 5A and 5B. FIG. 6 illustrates a close up view of the internal electro/mechanical structure and the inter-conducting insulated copper wire 42, 43, 44.

Figure 16:
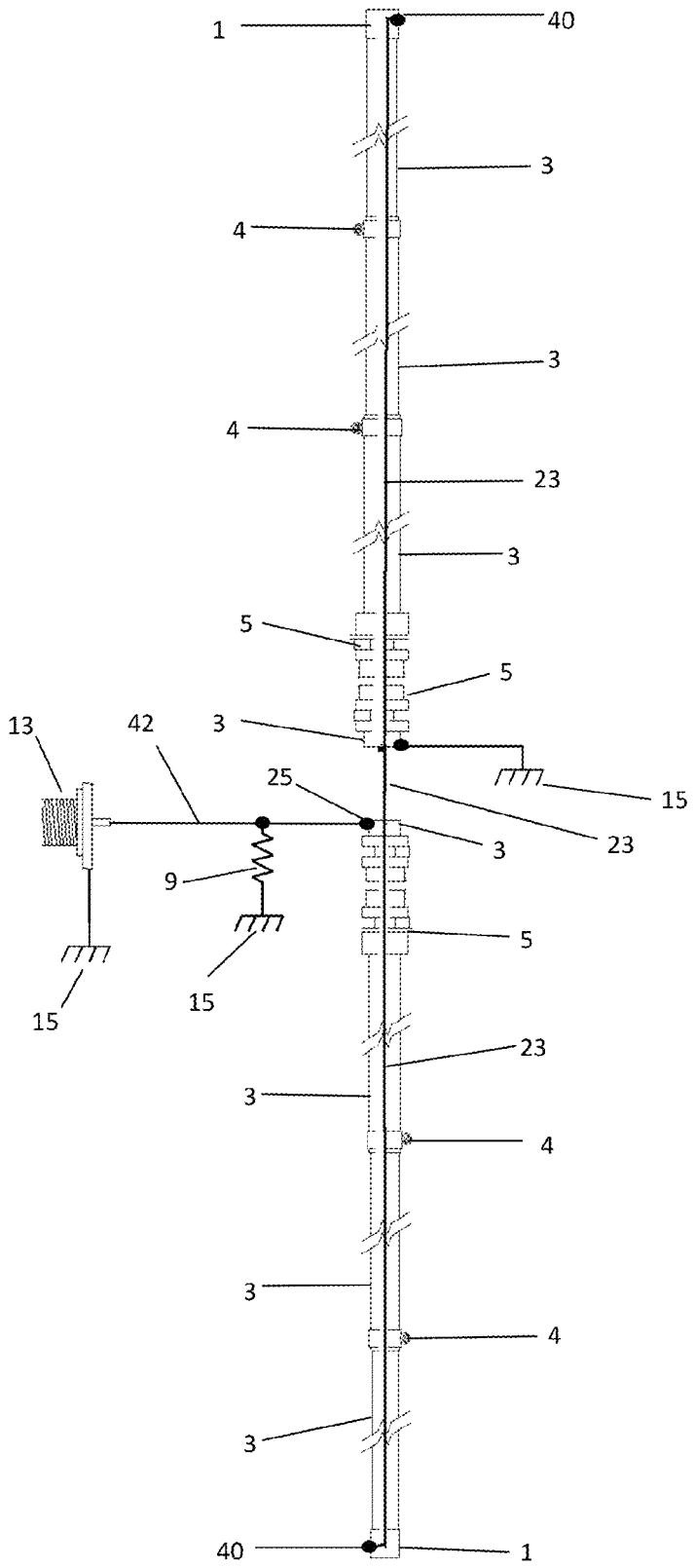
FIG. 16 illustrates a schematic diagram of an exemplary antenna as shown in FIG. 4, 5A, 5B and FIG. 6

Referring to FIG. 16 illustrates a schematic drawing showing details of an exemplary dipole driven element configuration. In this configuration, the Nichrome resistive cable assembly 23 is not grounded at 15; instead, it is connected end-to-end of the aluminum elements tubing 3 and terminated at each point 40. Insulated copper wire 42 connects to the center contact of the coaxial receptacle 13 to resistor 9.

Figure 7:
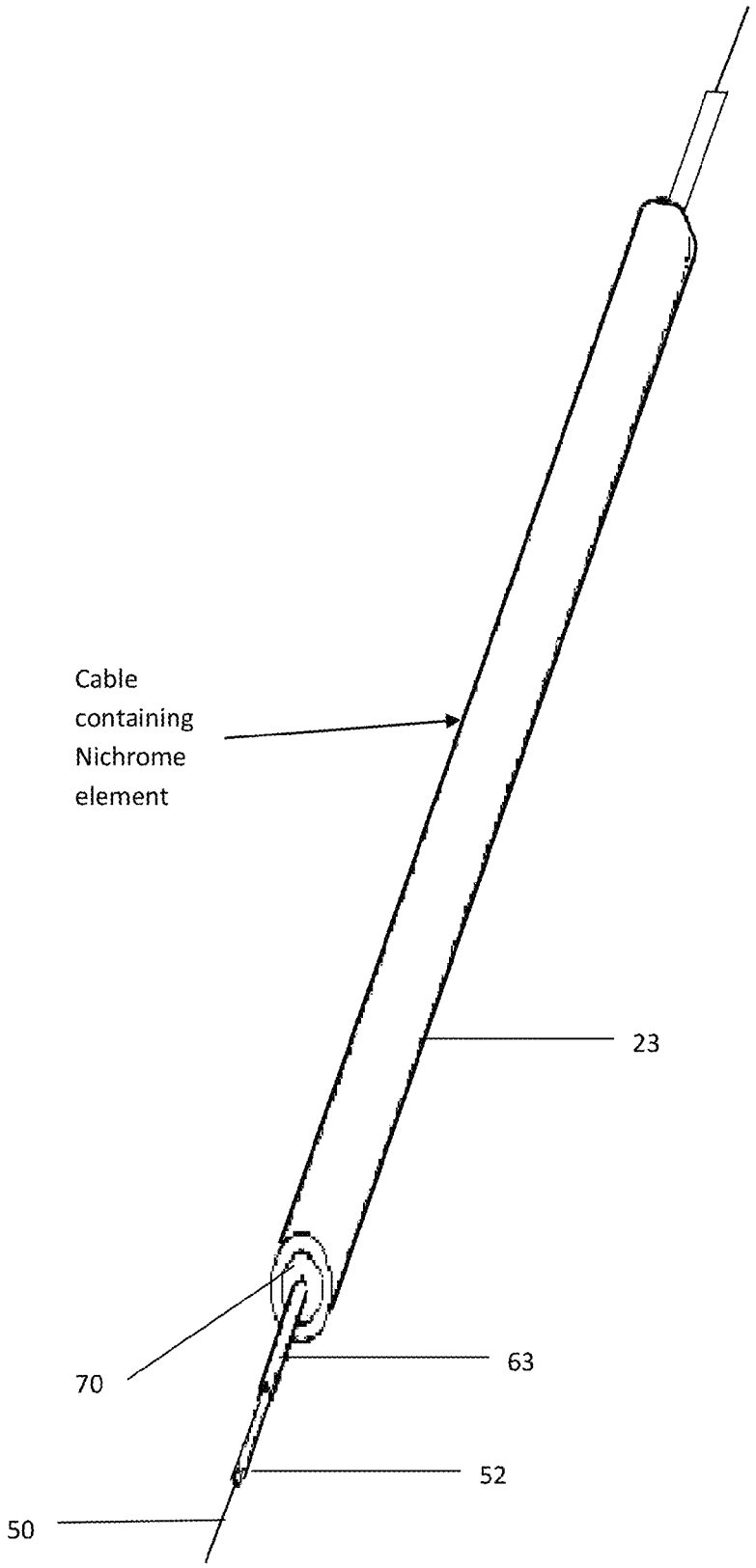
FIG. 7 illustrates a view of the main Nichrome element cable assembly as used throughout the various configurations.
Figure 8:
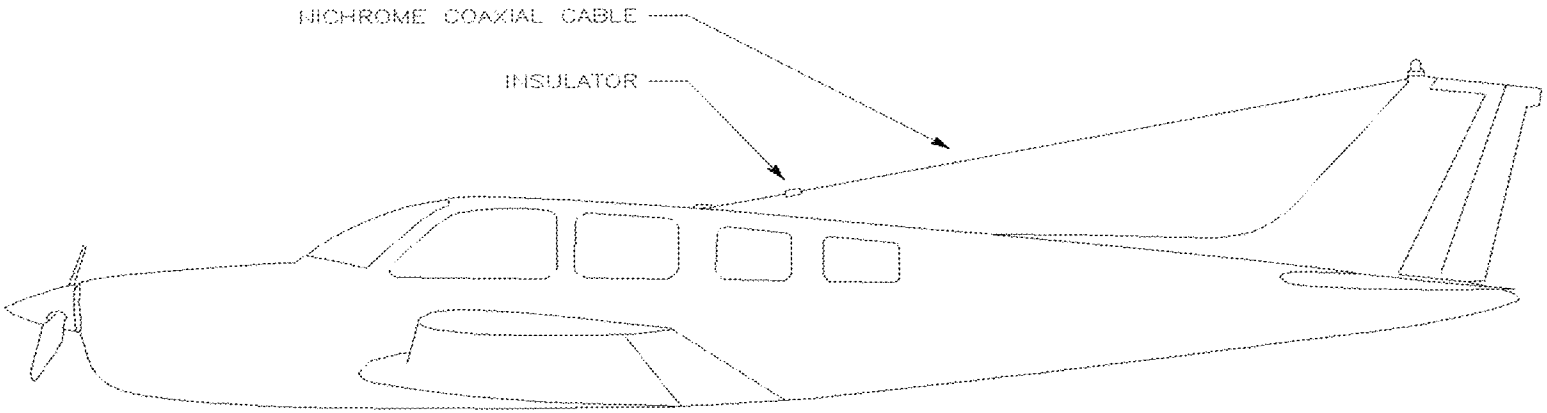
FIG. 8 illustrates a typical installation of the Nichrome resistive element in coaxial form installed on an aircraft.

Referring to FIG. 7, the drawing illustrates an exemplary Nichrome resistive cable assembly 23 advantageously used throughout this embodiment. A Nichrome resistance wire 50 is sheathed in a Silica insulation sleeve 52, advantageously, although not necessarily, formed of high temperature PTFE, and covered in a high temperature (e.g., thick fiberglass) insulation sleeve 63 and covered in flexible (e.g. foam core) insulation 70 and finally covered in an outer jacket 23 for the completed assembly. This cable assembly 23 can be made in variations to serve another purpose as shown in FIG. 8, which illustrates a typical use on an aircraft. The variation would add a conductive outer shielding between the core 70 and the outer protective jacket 23. This added conductive outer shielding would take the place of the aluminum element tubing 3 as shown elsewhere herein.

Figure 9:
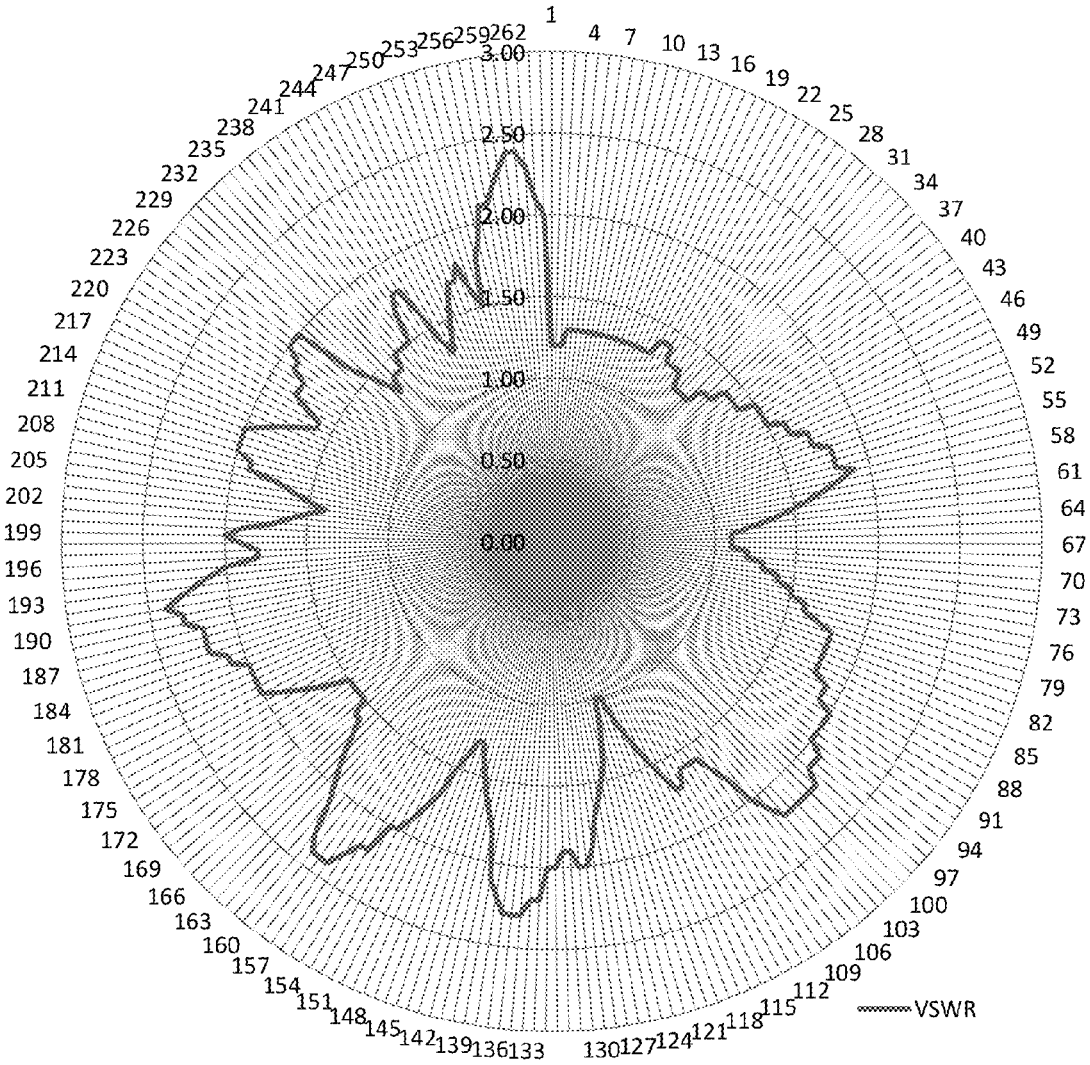
FIG. 9 illustrates a polar chart of this inventions VSWR readings from 1 MHz to 262 MHz
Figure 10A:
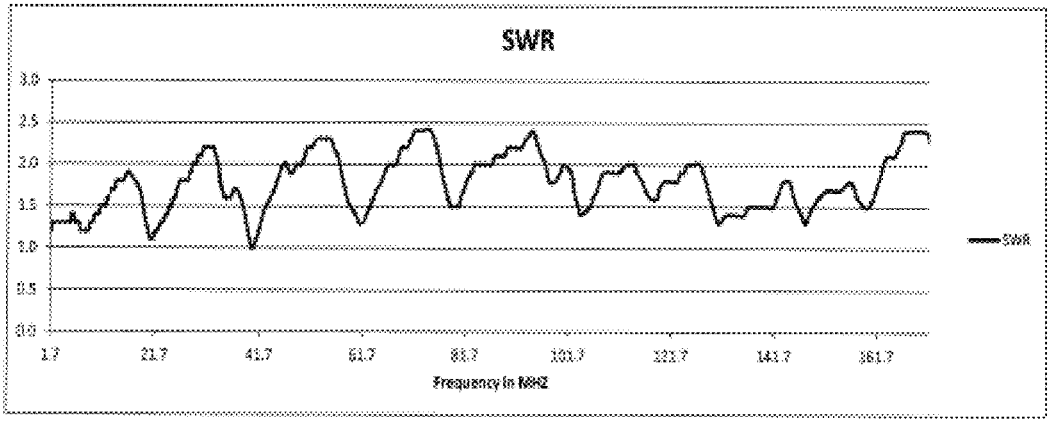
FIG. 10A, 10B, 10C shows graphs of VSWR readings at various frequencies for an expanded view.
Figure 10B:
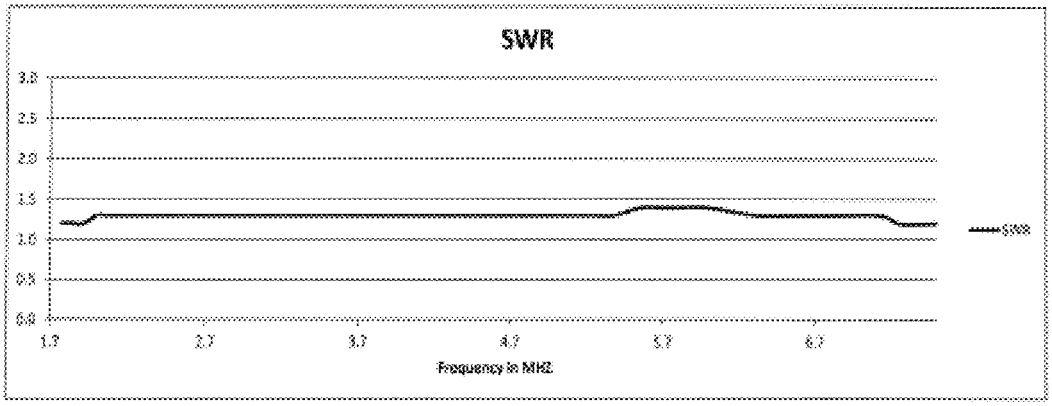
Figure 10C:
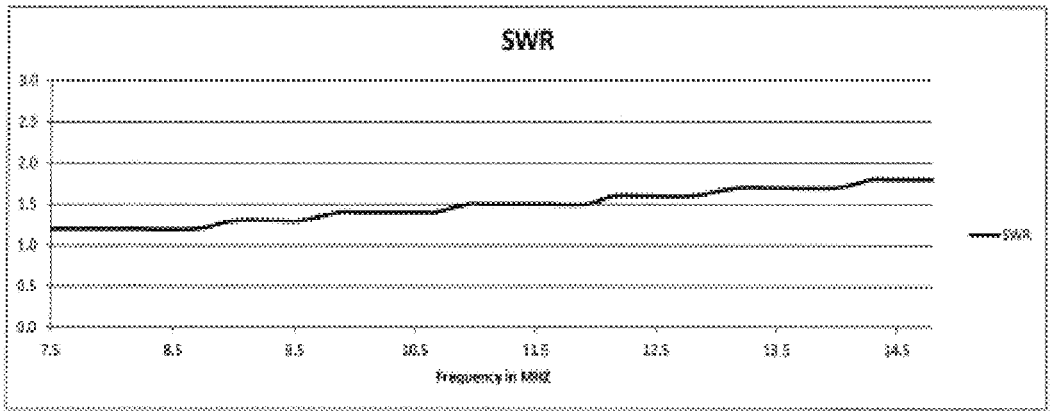
Figure 11A:
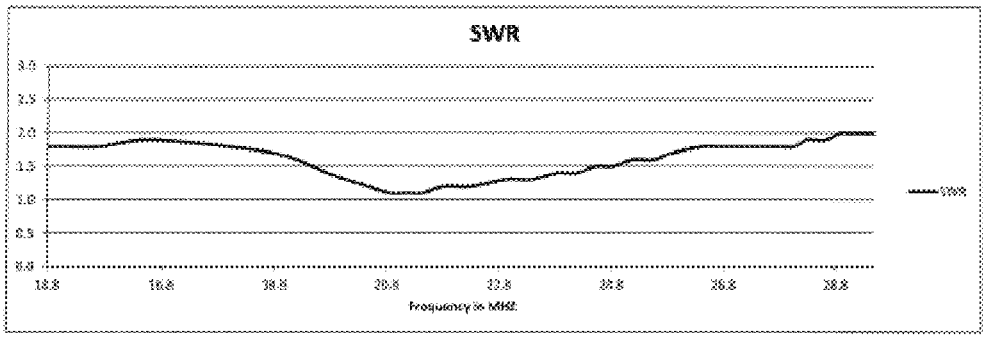
FIGS. 11A-11D, show graphs of VSWR readings at various frequencies for an expanded view.
Figure 11B:
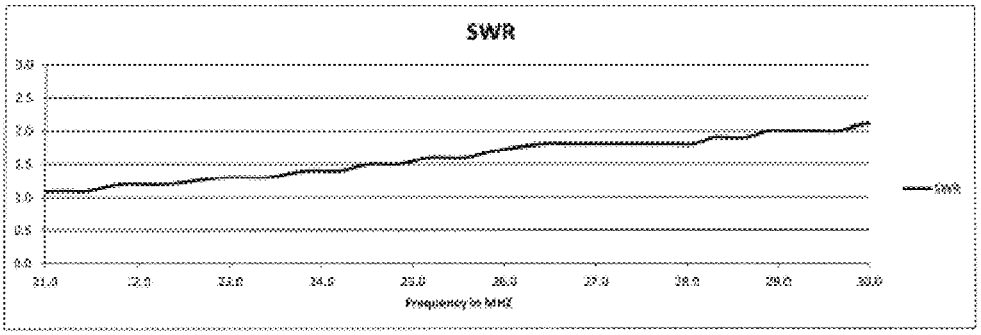
Figure 11C:
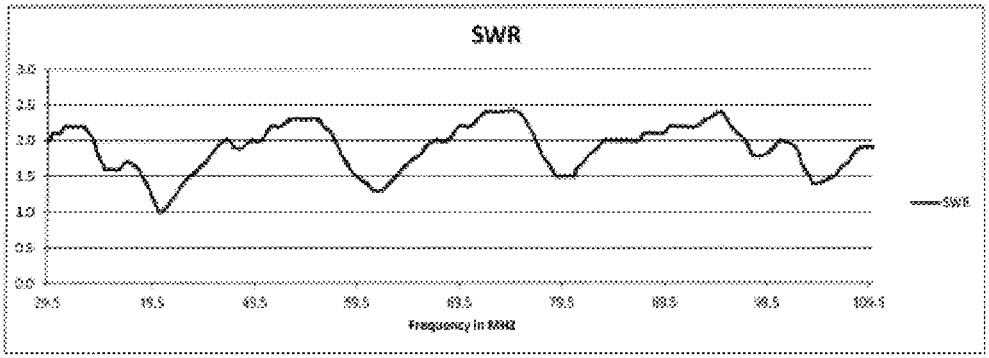
Figure 11D:
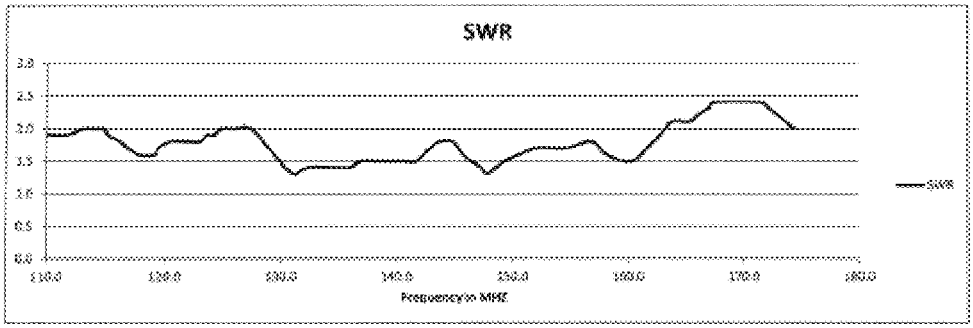

Referring to FIG. 9 illustrates a polar chart made from collecting data from an antenna as described herein, using readings taken from a MFJ-259B antenna analyzer (MFJ Enterprises, Inc., Starkville, Miss.). The data represented in FIG. 9 are from actual readings taken from an antenna thus far described herein as built from FIG. 1, FIG. 2, FIG. 3A, 3B, 3C, FIG. 14, and FIG. 15. The chart shows the VSWR readings verses Frequency in MHz with all readings below 2.5:1 and lower.

Referring to FIG. 10A, 10B, 10C, 11A, 11B, 11C, 11D, the drawings illustrate plots graphed as well, with an expanded view for various frequencies to give a closer look on how flat the VSWR remains over a broad range of the band of frequencies.

Figure 12A:
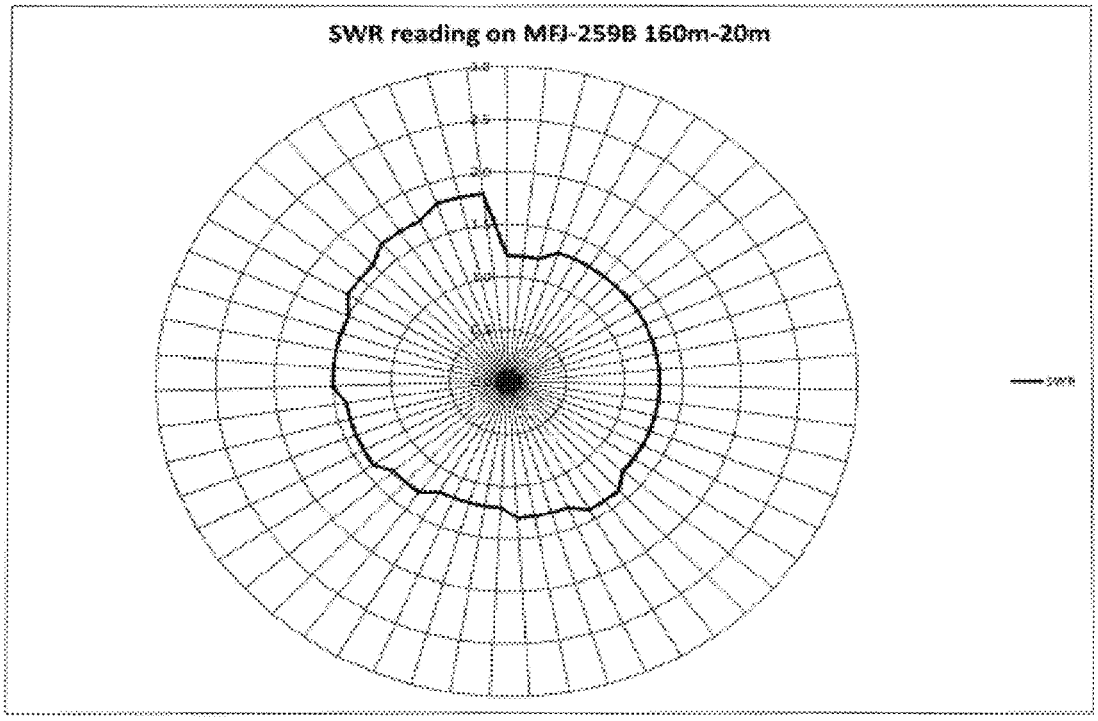
FIGS. 12A, 12B, 13A, and 13B shows polar charts of VSWR readings at various frequencies in expanded views for clarity.
Figure 12B:
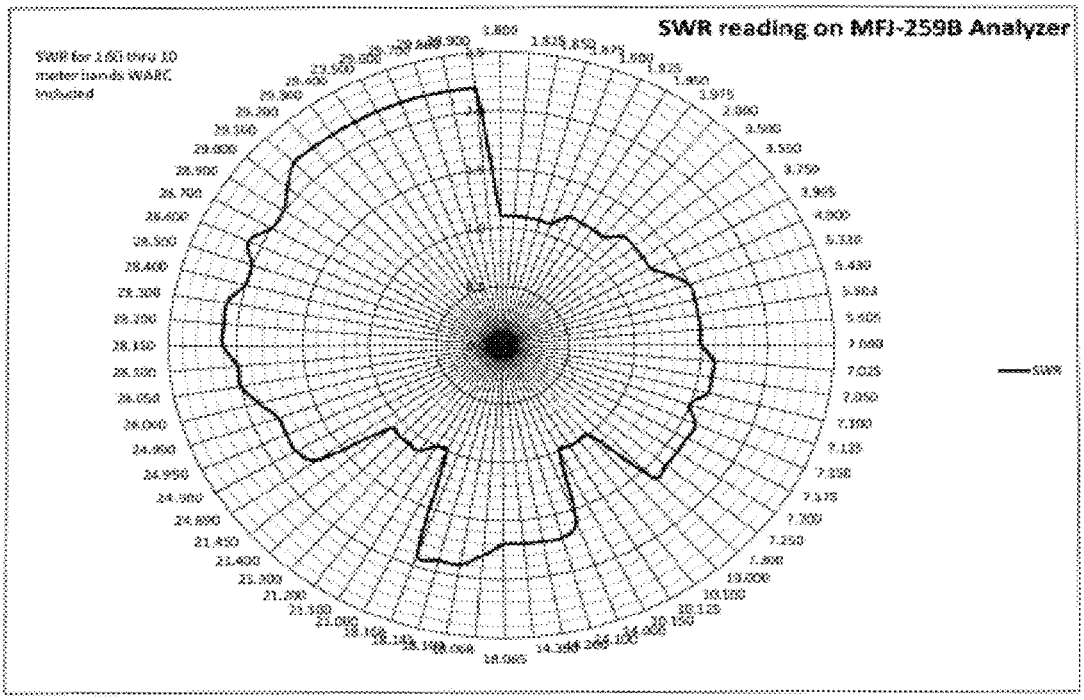

Referring to FIG. 12A, 12B, the drawings illustrate two more polar charts for an expanded view of the VSWR readings over another range of frequencies for a closer view.

Figure 13A:
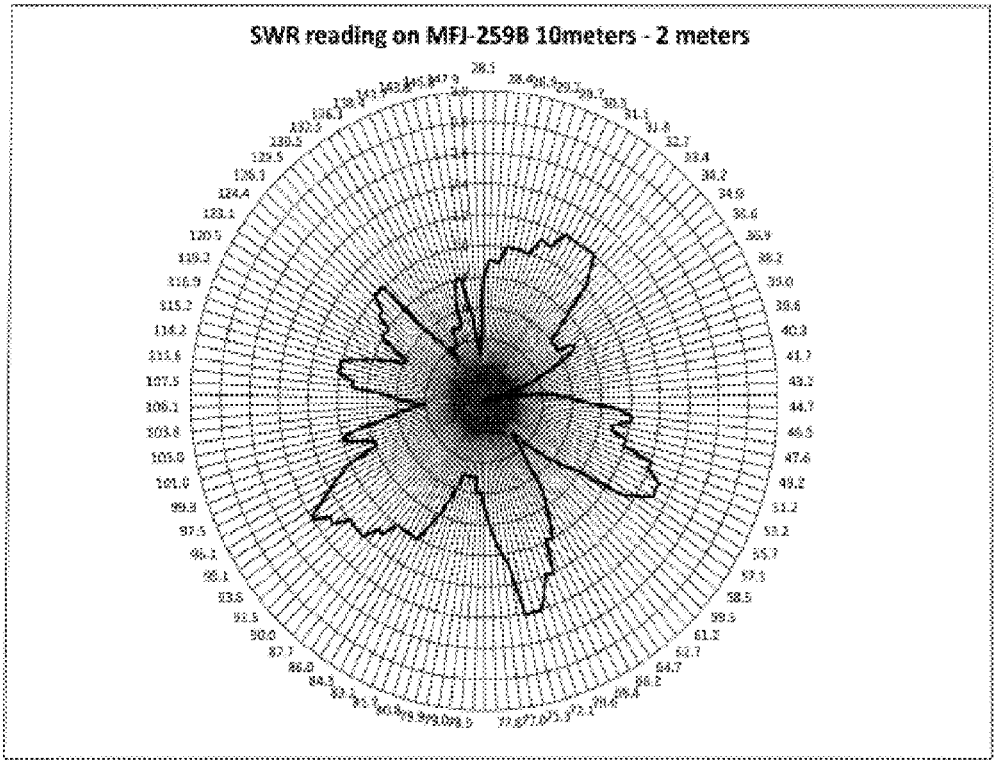

Referring to FIG. 13A, the drawing illustrates a polar chart for an expanded view of the VSWR readings over a range from 10 meter through 2 meter band.

Figure 13B:
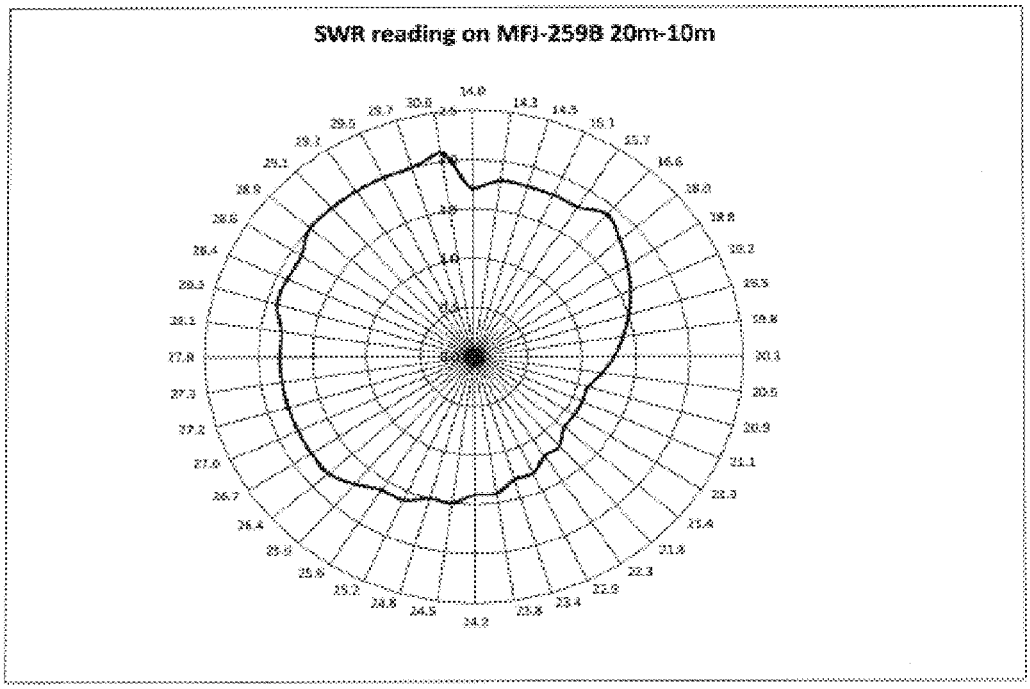

Referring to FIG. 13B, the drawing illustrates a polar chart for an expanded view of the VSWR readings over a range from 20 meter through the 10 meter band.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. An antenna comprising:

an elongate nichrome resistive element; and an electrically conductive sheath surrounding the elongate nichrome resistive element;

wherein the elongate nichrome resistive element and the electrically conductive sheath are electrically in a closed circuit.

2. An antenna according to claim 1, wherein:

the electrically conductive sheath comprises a tube having a sidewall and two ends;

the elongate nichrome resistive element extends through the tube without being in electrical contact with the tube sidewall; and the elongate nichrome resistive element is in electrical contact with one of the tube ends.

3. An antenna according to claim 1, further comprising a resistive element, wherein resistive element, the elongate nichrome resistive element, and the electrically conductive sheath are electrically in a closed circuit.

4. An antenna according to claim 3, wherein the closed circuit has a resistance of 50 Ohms.

5. An antenna according to claim 1, wherein the wherein the elongate nichrome resistive element and the electrically conductive sheath are configured as a dipole.

6. An antenna according to claim 1, wherein the elongate nichrome resistive element comprises a nichrome resistance wire, and further comprising:

a insulation sleeve immediately surrounding the nichrome resistance wire;

a high temperature insulation sleeve immediately surrounding the insulation sleeve;

a flexible insulation layer immediately surrounding the high temperature insulation sleeve; and an outer jacket immediately surrounding the flexible insulation layer.

7. An antenna according to claim 1, wherein the elongate nichrome resistive element comprises a nichrome resistance wire, and further comprising:

an insulation sleeve immediately surrounding the nichrome resistance wire;

a high temperature insulation sleeve immediately surrounding the insulation sleeve; and a flexible insulation layer immediately surrounding the high temperature insulation sleeve;

wherein the electrically conductive sheath immediately surrounds the flexible insulation layer.

8. An antenna according to claim 1, further comprising:

three non-inductive resistors, configured with the elongate nichrome resistive element and the electrically conductive sheath in a ¾-bridge arrangement.

* * * * *